US006378998B2

(12) United States Patent
Lim et al.

(10) Patent No.: US 6,378,998 B2
(45) Date of Patent: Apr. 30, 2002

(54) INK TANK FOR INK JET PRINTER

(75) Inventors: Dae-soon Lim, Yougin; Jae-ho Moon, Suwon, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/750,310

(22) Filed: Dec. 29, 2000

(30) Foreign Application Priority Data

Dec. 29, 1999 (KR) ..... 99-64469

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,557,310 A * 9/1996 Kurata et al. ..... 347/87
5,940,104 A * 8/1999 Karita et al. ..... 347/87

FOREIGN PATENT DOCUMENTS

JP 8-90783 4/1996
JP 08090783 A * 4/1996 ..... B41J/2/175

* cited by examiner

*Primary Examiner*—Anh T. N. Vo
(74) *Attorney, Agent, or Firm*—Robert E. Bushnell, Esq.

(57) ABSTRACT

An ink tank for an ink jet printer is provided. The ink tank includes a tank body, a sponge disposed in the tank body, for absorbing and storing ink, an air flow member positioned above the sponge, for guiding air outside the ink tank to be induced into the ink tank, a nozzle coupled to one end of the air flow member, for supplying air outside the ink tank to the ink tank, and an air flow hole formed at one side of the tank body connected to the other end of the air flow member, and opened/closed by a sealing means installed on a printer frame according to the movement of the carrier and the ink tank. The air outside the ink tank is supplied only during the printing operation, thereby preventing evaporation of moisture contained in the ink stored in the ink tank. Also, the internal pressure of the ink tank is adjusted to be lower than the atmospheric pressure, thereby preventing leaking of ink.

31 Claims, 3 Drawing Sheets

INK TANK FOR INK JET PRINTER

CLAIM OF PRIORITY

This application makes reference to, incorporates the same herein, and claims all benefits accruing under 35 U.S.C. §119 from my application INK TANK FOR INK-JET PRINTER filed with the Korean Industrial Property Office on Dec. 29, 1999 and there duly assigned Ser. No. 1999/64469.

BACKGROUND OF THE INVENTION

1. Field of the Invention

The present invention relates to an ink tank for an ink jet printer, and more particularly, to an ink tank capable of preventing evaporation of moisture from ink stored in the ink tank and preventing leaking of ink, by installing a separate air flow member within the ink tank and by providing a sealing means for automatically opening/closing an air inflow hole of the ink tank according to movement of the ink tank.

2. Description of the Related Art

In general, an ink tank for an ink jet printer, for storing ink for use in printing, is housed in a carrier provided within the printer, and supplies ink while moving according to the movement of the carrier during the printing mode. However, ink jet printers suffers from two problems. First, the pressure inside the ink tank is equal to the atmospheric pressure outside the tank, causing ink to leak out about the nozzle. Second, the air inflow valve may be open during operation of an ink-jet printer and also when the ink jet printer is not operating. This causes the ink inside the ink tank to dry up.

What is needed is an improved ink jet printer that 1) reduces the pressure inside the ink tank below atmospheric pressure, and 2) a mechanism for sealing the air inflow hole when the ink jet printer is not being used, to prevent the ink inside the ink tank from drying up.

SUMMARY OF THE INVENTION

It is therefore an object of the present invention to provide an improved ink jet printer.

It is yet another object to provide an ink jet printer that automatically seals up the air inflow hole when the ink jet printer is not in use, preventing ink from drying up in the ink tank.

It is still yet another object to provide an ink jet printer where the pressure inside the ink tank is below atmospheric pressure to prevent ink from leaking from the ink tank and from the nozzles.

It is also an object of the present invention to provide an ink tank which can prevent evaporation of moisture contained in ink stored in the ink tank, by providing a sealing means for automatically opening/closing an air inflow hole of the ink tank according to movement of the ink tank, such that the air inflow hole is opened in a printing mode to discharge ink and the air inflow hole is closed in a printing standby mode to prevent the ink tank from being exposed to the atmosphere.

It is another object of the present invention to provide an ink tank which can prevent a leaking, by installing an air flow member within the ink tank and by mounting a nozzle at one end of the air flow member, so that the internal pressure of the ink tank is adjusted to be smaller than the atmospheric pressure.

Accordingly, to prevent evaporation of moisture from the ink tank, there is provided an ink tank for an ink jet printer including a tank body, a sponge disposed in the tank body, for absorbing and storing ink, an air flow member positioned above the sponge, for guiding air outside the ink tank to into the ink tank, a nozzle coupled to one end of the air flow member, for supplying air outside the ink tank to the ink tank, and an air flow hole formed at one side of the tank body connected to the other end of the air flow member. The air flow hole is opened and closed by a sealing means installed on a printer frame according to movement of the carrier and the ink tank. The sealing means preferably includes a sealing ball being in contact with the air flow hole and a spring for elastically supporting the sealing ball, and is installed perpendicular or parallel to the movement direction of the ink tank, thereby opening the air inflow hole in the printing mode and closing the air inflow hole in the printing standby mode. The air flow member may be a hose made of a material that does not chemically react with ink, and is preferably spirally wound around a shaft ranging from one end connected with the nozzle to the other end connected to the air inflow hole.

To prevent leaking, the air flow member is connected to a nozzle that has a diminishing internal diameter appropriate for lowering the internal pressure of the ink tank below atmospheric pressure.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
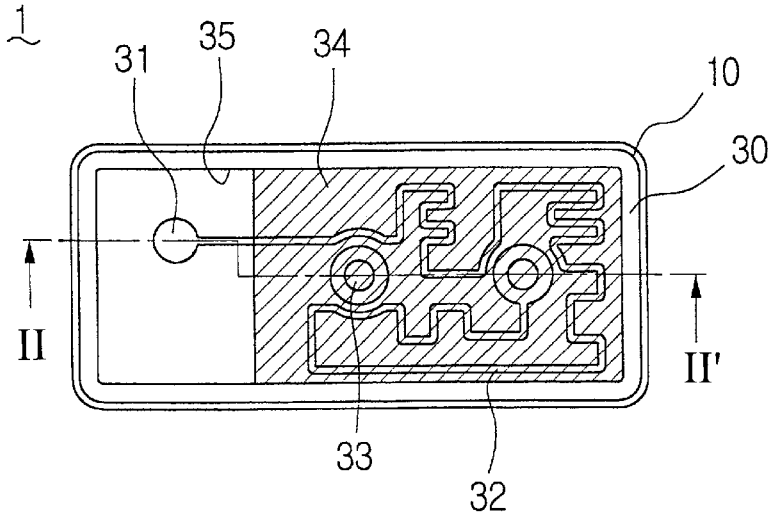
FIG. 1 (RELATED ART)
FIG. 1 is a plan view illustrating an ink tank for an ink jet printer.
Figure 2:
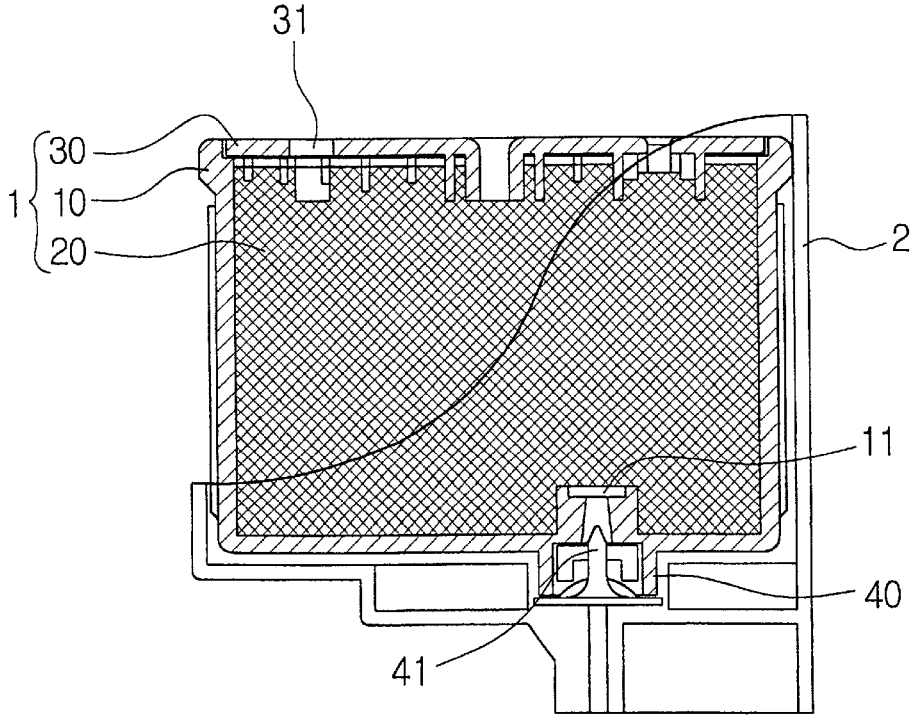
FIG. 2 (RELATED ART)
FIG. 2 is a cross-sectional view, taken along the line II–II' shown in FIG. 1, for showing the ink tank is housed in a carrier.

FIGS. 1 and 2 show an ink tank. FIG. 1 is a plan view of an ink tank and FIG. 2 is a cross-sectional view thereof, taken along the line II–II' shown in FIG. 1, in a state the inktank is housed in a carrier. As shown in FIGS. 1 and 2, ink tank 1 includes a box-like tank body 10 having a predetermined space, a sponge 20 compressively housed in the tank body 10 with a constant compression ratio, for absorbing and depositing ink, and a cap 30 for capping the tank body 10. An ink discharge hole 11 for discharging ink in the ink tank 1 to a carrier 2 is provided in the lower portion of the tank body 10.

The cap 30 includes an air inflow hole 31 for inducing air outside the ink tank 1, that is, ambient air, into the inside of the ink tank 1. An air flow path 32 guides the air induced through the air inflow hole 31 to be uniformly distributed inside the ink tank 1 and for adjusting the evaporation amount of moisture contained in ink, and an ink injection hole 33 for refilling the ink tank 1 with ink when there is insufficient ink contained in the ink tank 1.

The completed ink tank 1 is in a state that a thin vinyl cover 34 is attached to the top surface of the cap 30. Vinyl cover 34 peels off upon replacement of the used ink tank 1 with a new one. FIG. 1 shows the ink tank 1 with the vinyl cover 34 partially removed. Reference numeral 35 denotes a portion where the vinyl cover 34 is removed. If the vinyl cover 34 is removed in such a manner, the air inflow hole 31 is open to the atmosphere. The atmospheric air is induced through the opened air inflow hole 31 to then be distributed in the ink tank 1 along the air flow path 32.

Due to the induction of air, the pressure of the ink tank 1 becomes equal to the atmospheric pressure. The atmospheric pressure applied over the ink tank 1 allows the ink absorbed and deposited in the sponge 20 to flow out toward the ink discharge hole 11 due to the capillary action of the sponge 20. In a printing mode, the ink flowing toward the ink discharge hole 11 is discharged through a head nozzle 41 mounted on a head 40, thereby achieving printing.

However, in the ink tank 1, since the air inflow hole 31 of the cap 30 is always exposed to the air even in the printing standby mode as well as in the printing mode, moisture formed by the ink easily evaporates through the air inflow hole 31, so that the viscosity of the ink increases. If the viscosity of the ink increases, it is not possible to keep or use the ink for a long time. Also, ink which has not been used for a long time must be thrown away. Further, since the internal pressure of the ink tank 1 is kept equal to the atmospheric pressure, ink leaks through the ink discharge hole 11 due to its own weight and atmospheric pressure, resulting in "leaking", the state that the ink is exhausted through the head nozzle 41, irrespective of the performance of printing.

Figure 3:
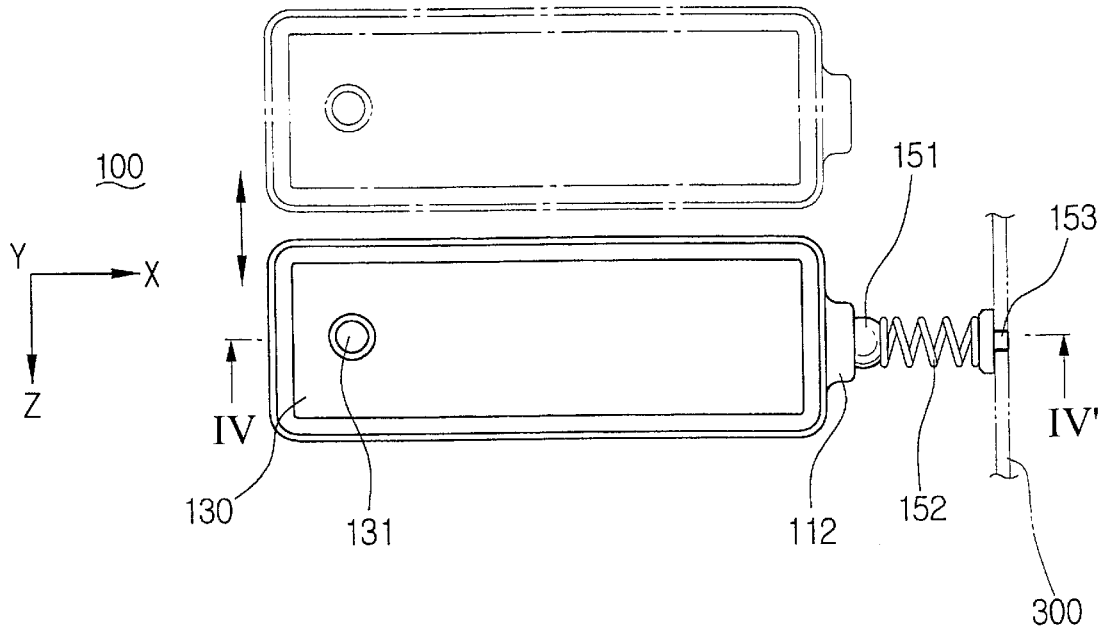
FIG. 3 is a plan view illustrating an ink tank according to a first embodiment of the present invention.
Figure 4:
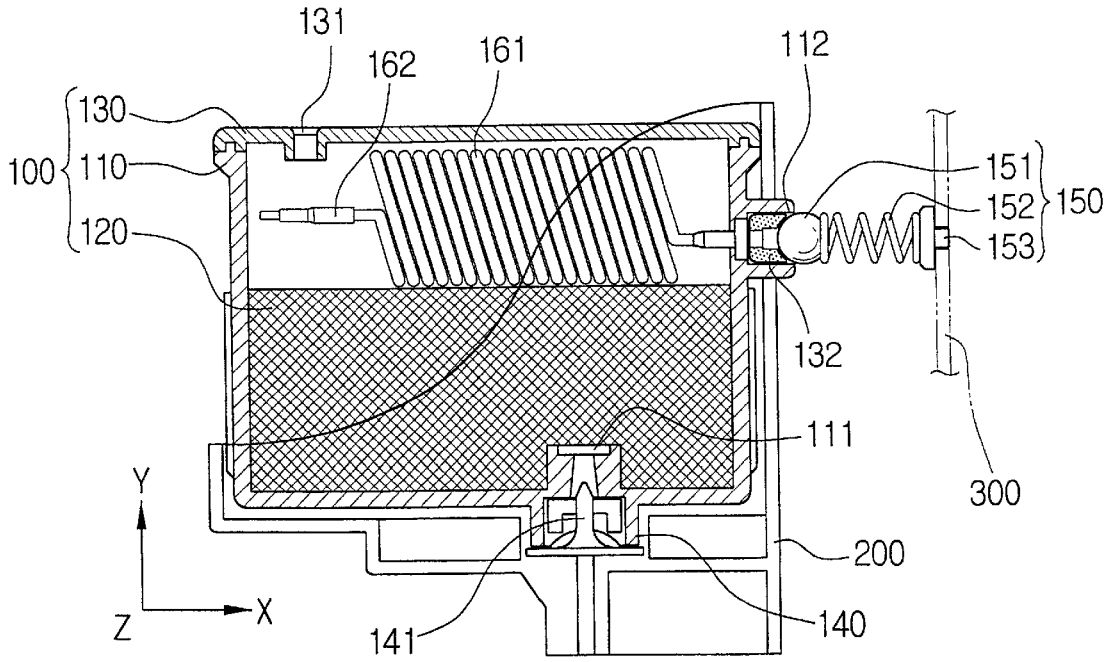
FIG. 4 is a cross-sectional view, taken along the line IV–IV' shown in FIG. 3, for showing the ink tank according to the first embodiment of the present invention being housed in a carrier.

FIGS. 3 and 4 show the first embodiment of the ink tank according to the present invention, in which FIG. 3 is a plan view of the ink tank according to the present invention and FIG. 4 is a cross-sectional view, taken along the line IV–IV' shown in FIG. 3. As shown in FIGS. 3 and 4, the ink tank 100 of the invention includes a box-like tank body 110 having a predetermined space, a sponge 120 compressively housed in the tank body 110 with a constant compression ratio, for absorbing and depositing ink, and a cap 130 for capping the tank body 110.

An ink discharge hole 111 for discharging ink in the ink tank 110 to a carrier 200 is provided in the lower portion of the tank body 110, and an air inflow hole 112 is formed at one side of the tank body 110, respectively. The cap 130 includes an ink injection hole 131 for refilling ink when there is an insufficient amount of ink contained in the ink tank 100. A lid (not shown) is detachably fixed to the ink injection hole 131 so that the ink injection hole 131 is opened only for ink injection. Also, an air flow member 161 for guiding air outside the ink tank 100 into the ink tank 100 is installed between the sponge 120 and the cap 130. Also, a nozzle 162 for supplying air outside the ink tank 100 to the ink tank 100, is coupled to one end of the air flow member 161. An air inflow hole 112 is coupled to the other end of the air flow member 161 and is opened/closed by a sealing means 150 installed on a printer frame 300.

Since the air flow member 161 is brought into direct contact with the ink, it is preferably a hose made of a material that does not chemically react with ink. In this embodiment, a silicon hose is used as the air flow member 161. Also, the air flow member 161 is spirally wound around a shaft ranging from one end thereof coupled to the nozzle 162 to the other end thereof coupled to the air inflow hole 112. This is for allowing ambient air to be induced into the ink tank 100 with a constant pressure by increasing the length of the air flow path. Accordingly, an increase or decrease in the internal pressure of the ink tank 100, which may be caused when ink is discharged, can be prevented. Also, it is easy to adjust the length of the air flow member 161 during installation thereof, to obtain a desired level of the internal pressure of the ink tank 100 according to the volume of the ink tank 100.

The nozzle 162 coupled to one end of the air flow member 161 is a scaled-down nozzle which gradually diminishes in inner diameter with respect to the traveling direction of air. The air having passed through the air flow member 161, flows faster via the nozzle 162, while decreasing in pressure. Thus, the internal pressure of the ink tank 100 becomes smaller than the pressure of the outside of the ink tank 100, that is, the atmospheric pressure. A difference in pressure between the ink tank 100 and the outside thereof becomes greater as the inner diameter of the nozzle 162 becomes smaller. Since the degree of internal pressure of the ink tank 100 depends on a length of the inner diameter of the nozzle 162, a desired internal pressure of the ink tank 100 can be attained, by selecting a nozzle having an appropriate inner diameter according to the volume of the ink tank 100 while fabricating the same.

The sealing means 150 includes a sealing ball 151 being in direct contact with the air inflow hole 112, a spring 152 for elastically supporting the sealing ball 151, and a fixing pin 153 for fixing the spring 152 to the printer frame 300. In this embodiment, the sealing means 150 is disposed perpendicular to the movement direction of the carrier 200 and the ink tank 100 according to the printing operation. Also, a packing 132 made of soft rubber or synthetic resin is seated in the air inflow hole 112. When the air flow hole 112 is hermetically sealed, the sealing ball 151 is closely fixed to the packing 112 by an elastic force of the spring 152, thereby preventing outflow of air to the outside of the ink tank 100 or inflow of air into the ink tank 100.

The procedure of opening or closing the air inflow hole 112 according to this embodiment will be described. FIGS. 3 and 4 show the ink tank 100 being at its original place in the printing standby state. At the original place, the air inflow hole 112 is closed by the sealing means 150. When the printing operation starts, the carrier 200 and the ink tank 100 move along the Z axis for performing the printing operation, as shown in FIG. 3. Accordingly, the spring 152 is slightly compressed to thus separate the sealing ball 151 from the air inflow hole 112, thereby opening the air inflow hole 112. The atmospheric air is induced into the ink tank 100 through the opened ink inflow hole 112, so that the ink absorbed and stored in the sponge 120 flows toward the ink discharge hole 111 due to capillary action of the sponge 120 under the atmospheric pressure applied to the upper portion of the ink tank 100. The ink flowing toward the ink discharge hole 111 is discharged through the head nozzle 141 mounted in the head 140, thereby achieving printing. Here, the internal pressure of the ink tank 100 is smaller than the atmospheric pressure as described above. If the printing operation is completed, the carrier 200 and the ink tank 100 return to their original positions and the air inflow hole 112 is closed by the sealing means 150 in the reversing of the opening procedure.

Figure 5:
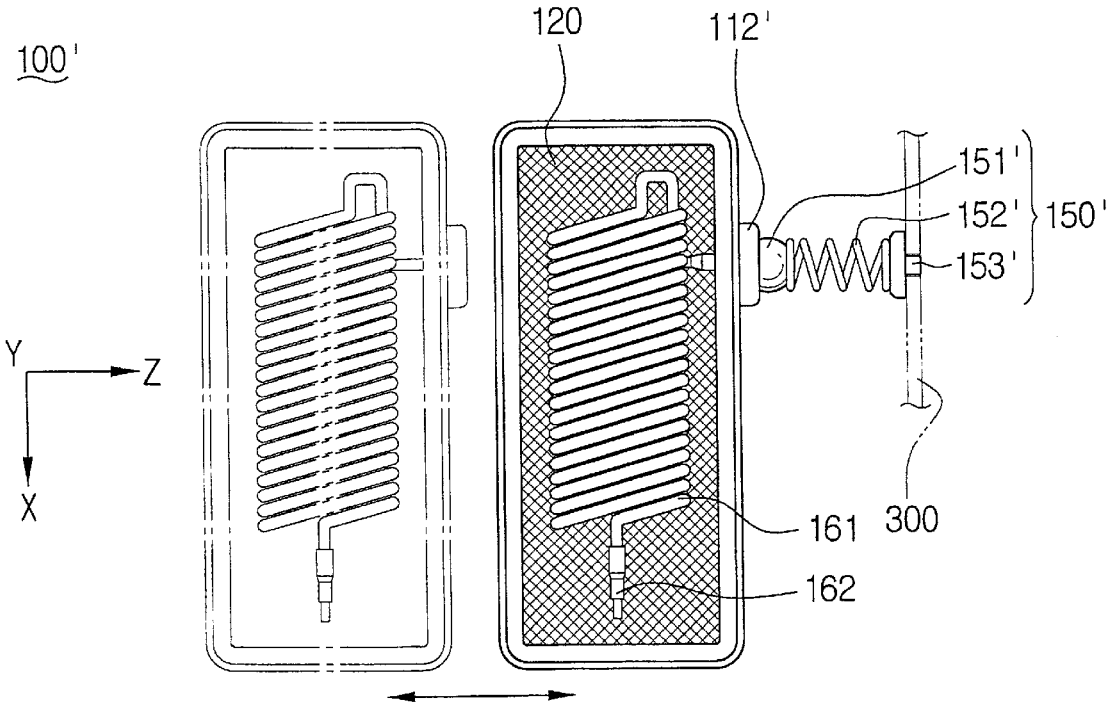
FIG. 5 is a plan view illustrating an ink tank according to a second embodiment of the present invention, for showing a cap being removed.
Figure 6:
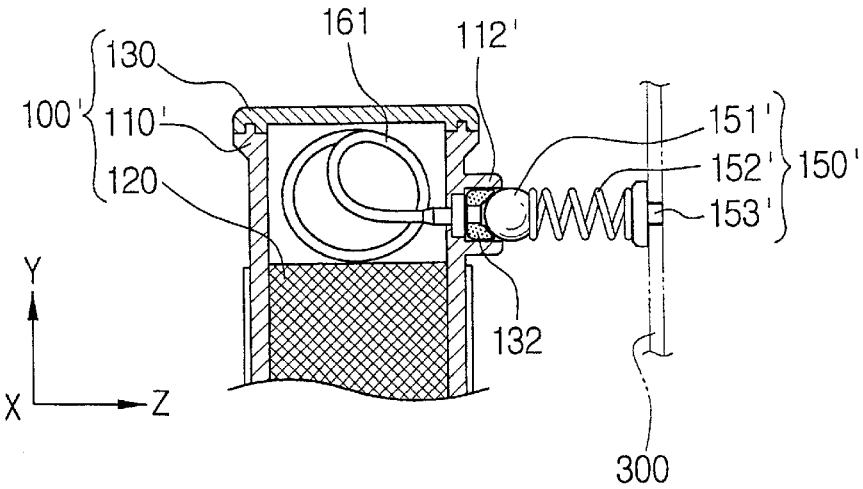
FIG. 6 is a front sectional view illustrating essential parts of the ink tank according to the second embodiment of the present invention.

FIGS. 5 and 6 show another embodiment of the present invention, in which FIG. 5 is a plan view of an ink tank according to this embodiment for showing the cap in the upper portion of a tank body being removed, and FIG. 6 is a front sectional view thereof. As shown in FIGS. 5 and 6, this embodiment is almost similar to the first embodiment in view of the construction of the ink tank. However, the feature of this embodiment lies in that an air inflow hole 112' and a sealing means 150' are parallel to the movement direction of an ink tank 100'.

As shown in FIG. 5, at an original place, the air inflow hole 112' is closed by the sealing means 150'. When the printing operation starts, the ink tank 100' moves along the Z axis for performing the printing operation. Accordingly, the sealing ball 151' is separated from the air inflow hole 112', thereby opening the air inflow hole 112'. Then, the atmospheric air is induced into the ink tank 100' through the opened ink inflow hole 112'.

If the printing operation is completed, the ink tank 100' is restored to its original position so that the air inflow hole 112' and the sealing ball 151' are brought into contact with each other to compress a spring 152', thereby closing the air inflow hole 112'. Also, the sealing ball 151' is completely fitted into a packing 132, thereby preventing inflow of air into the ink tank 100' through the air inflow hole 151' or outflow of air to the outside of the ink tank 100'.

As described above, the ink tank according to the present invention is provided with a sealing means for opening an air inflow hole to discharge ink in the printing mode and for closing the air inflow hole to prevent ink stored in the ink tank from being exposed to the atmosphere in the printing standby mode, thereby preventing evaporation of the moisture contained in the ink. Also, an air flow member is installed within the ink tank, a nozzle is installed at one end of the air flow member, and the internal pressure of the ink tank is adjusted to be smaller than the atmospheric pressure, so that the leaking of ink can be prevented.

Although the invention has been illustrated and described with respect to exemplary embodiments thereof, the present invention should not be understood as limited to the specific embodiments set out above but various changes and modifications may be made by those skilled in the art, without departing from the spirit and scope of the present invention set out in the appended claims.

What is claimed is:

1. An ink tank for an ink jet printer, for storing ink for use in printing and housed in a carrier of the printer, the ink tank comprising:

a tank body;

a sponge disposed in the tank body, for absorbing and storing ink;

an air flow member positioned above the sponge, for guiding air outside the ink tank to be introduced into the ink tank;

a nozzle coupled to one end of the air flow member, for supplying air outside the ink tank to the ink tank; and an air flow hole formed at one side of the tank body connected to the other end of the air flow member, and opened and closed by a sealing means installed on a printer frame according to movement of the carrier and the ink tank.

2. The ink tank according to claim 1, wherein the sealing means includes a sealing ball being in contact with the air flow hole and a spring for elastically supporting the sealing ball.

3. The ink tank according to claim 2, wherein the sealing means installed perpendicular to the movement direction of the ink tank, opens the air inflow hole in the printing mode and closes the air inflow hole in the printing standby mode.

4. The ink tank according to claim 2, wherein the sealing means installed parallel to the movement direction of the ink tank, opens the air inflow hole in the printing mode and closes the air inflow hole in the printing standby mode.

5. The ink tank according to claim 1, wherein the air flow member is a hose made of a material that does not chemically react with ink, and is spirally wound around a shaft ranging from one end connected with the nozzle to the other end connected to the air inflow hole.

6. The ink tank according to claim 5, wherein the air flow member is formed of a silicon hose.

7. The ink tank according to claim 1, wherein the nozzle has an inner diameter appropriate for lowering the internal pressure of the ink tank below atmospheric pressure.

8. An ink jet printer, comprising:

a tank body containing liquid ink;

a sponge disposed within said tank body, said sponge being saturated with said liquid ink;

a nozzle on one side of said tank body, said nozzle having a small inner diameter opening;

an air inflow hole disposed on an opposite side of said tank body from said nozzle;

an air flow member connected between said nozzle and said air inflow hole, wherein air is jetted out of said tank body through said opening of said nozzle causing an air pressure inside said tank body to be below atmospheric levels preventing said liquid ink from leaking from said tank body, said air pressure inside said tank being a function of a diameter of said opening of said nozzle only when said ink jet printer is currently printing; and a sealing member forming a hermetic seal over said air inflow hole when said ink jet printer is not currently printing.

9. The ink jet printer of claim 8, said air flow member being spirally wound around a shaft.

10. The ink jet printer of claim 8, said sealing member comprising a sealing ball.

11. The ink jet printer of claim 10, said sealing member further comprising an elastic spring, one end of said spring being connected to a printer frame and the other end of said spring being connected to said sealing ball.

12. The ink jet printer of claim 11, wherein said ink tank moves during a printing operation in a direction perpendicular to an axis of said elastic spring.

13. The ink jet printer of claim 11, wherein said ink tank moves in a direction parallel to an axis of said elastic spring during a printing operation.

14. An ink jet printer, comprising:

a tank body containing liquid ink;

a sponge disposed within said tank body, said sponge being saturated with said liquid ink;

a nozzle on one side of said tank body; and an air inflow hole disposed on another side of said tank body, said air inflow hole being covered by a sealing device when said ink jet printer is not printing, said sealing device comprising:

a sealing ball capable of covering and sealing said air inflow hole; and a spring having an axis, said spring connected at one end to said sealing ball, said spring connected at another end to a printer frame.

15. The ink jet printer of claim 14, wherein said air inflow hole being uncovered when said ink jet printer is actually printing.

16. The ink jet printer of claim 15, further comprising an air flow member connected at one end to said air inflow hole and connected at another end to said nozzle.

17. The ink jet printer of claim 16, said ink tank moves during a printing operation in a direction perpendicular to said axis of said elastic spring.

18. The ink jet printer of claim 17, said nozzle having a small inner diameter that expels air from said ink tank causing said ink tank to have an internal pressure less than atmospheric pressure preventing leakage of ink from said ink tank and said nozzle.

19. The ink jet printer of claim 16, said ink tank moves in a direction parallel to said axis of said elastic spring during a printing operation.

20. The ink jet printer of claim 19, wherein said nozzle has a small inner diameter that expels air from said ink tank causing said ink tank to have an internal pressure less than atmospheric pressure preventing leakage of ink from said ink tank and said nozzle.

21. The ink jet printer of claim 16, wherein said air flow member is spirally would around a shaft ranging from one end connected with the nozzle and the other end connected to the air inflow hole.

22. A method for protecting an ink tank from drying up, comprising the steps of:

placing a carrier having said ink tank in a standby position with an air inflow hole covered by a sealing ball;

starting a print operation by moving said carrier comprising said ink tank; and automatically sliding said sealing ball off said air inflow hole of said ink tank exposing said ink tank to air from outside said ink tank.

23. The method of claim 22, further comprising the step of compressing a spring attached to said sealing ball as said carrier comprising said ink tank moves away from said standby position and begins said print operation.

24. The method of claim 22, further comprising the steps of:

completing said print operation;

moving said ink tank and said carrier to said standby position; and automatically having said sealing ball cover said air inflow hole of said ink tank.

25. An ink jet printer; comprising:

a tank body containing liquid ink;

a sponge disposed within said tank body, said sponge being saturated with said liquid ink;

a nozzle on one side of said tank body having an opening whose diameter is a function of a pressure difference between a pressure outside said tank and a pressure inside said tank only when said ink jet printer is printing; and an air inflow hole disposed on another side of said tank body, said air inflow hole being hermetically sealed by a sealing device when said ink jet printer is not printing.

26. The ink jet printer of claim 25, further comprising an air flow member connected at one end to said air inflow hole and connected at another end to said nozzle.

27. The ink jet printer of claim 26, said ink tank moves during a printing operation in a direction perpendicular to said axis of said elastic spring.

28. The ink jet printer of claim 27, said nozzle having an opening with an inner diameter resulting in a pressure gradient between said inside and said outside of said tank, said nozzle expels air from said inside of said ink tank causing said ink tank to have an internal pressure less than atmospheric pressure preventing leakage of ink from said inside of said ink tank to said outside of said ink tank only when said ink jet printer is printing.

29. The ink jet printer of claim 26, said ink tank moves in a direction parallel to said axis of said elastic spring during a printing operation.

30. The ink jet printer of claim 29, said nozzle having an opening with an inner diameter resulting in a pressure gradient between said inside and said outside of said tank, said nozzle expels air from said inside of said ink tank causing said ink tank to have an internal pressure less than atmospheric pressure preventing leakage of ink from said inside of said ink tank to said outsiude of said ink tank only when said ink jet printer is printing.

31. The ink jet printer of claim 26, said air flow member being spirally would around a shaft ranging from one end connected with the nozzle and the other end connected to the air inflow hole.

* * * * *